US011286722B2

(12) United States Patent
Kuhlman

(10) Patent No.: US 11,286,722 B2
(45) Date of Patent: Mar. 29, 2022

(54) DEFLECTOR ASSEMBLY AND METHOD FOR FORMING A MULTILATERAL WELL

(71) Applicant: Halliburton Energy Services, Inc., Houston, TX (US)

(72) Inventor: Michael Werner Kuhlman, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 44 days.

(21) Appl. No.: 16/781,737

(22) Filed: Feb. 4, 2020

(65) Prior Publication Data

US 2020/0256129 A1 Aug. 13, 2020

Related U.S. Application Data

(60) Provisional application No. 62/802,882, filed on Feb. 8, 2019.

(51) Int. Cl.

| | |
|---|---|
| ***E21B 7/06*** | (2006.01) |
| ***E21B 41/00*** | (2006.01) |
| ***E21B 43/26*** | (2006.01) |

(52) U.S. Cl.

CPC ..... *E21B 7/061* (2013.01); *E21B 41/0035* (2013.01); *E21B 43/26* (2013.01)

(58) Field of Classification Search

CPC ..... E21B 7/061; E21B 41/0035; E21B 43/26

See application file for complete search history.

(56) References Cited

U.S. PATENT DOCUMENTS 5,964,287 A * 10/1999 Brooks ..... E21B 23/12 166/117.6
6,019,173 A * 2/2000 Saurer ..... E21B 7/061 166/117.6

(Continued)

FOREIGN PATENT DOCUMENTS

AU 709101 B2 8/1999
CA 2266928 A1 * 4/1998 ..... E21B 41/0035

(Continued)

*Primary Examiner* — Matthew R Buck
(74) *Attorney, Agent, or Firm* — Scott Richardson; Parker Justiss, P.C.

(57) ABSTRACT

Provided, in one aspect, is a deflector assembly. The deflector assembly may include a tubular member, the tubular member having an uphole lateral wellbore tubular portion and a downhole main wellbore tubular portion. The deflector assembly may further include an exit window located in a sidewall of the uphole lateral wellbore tubular portion, and a ramped deflector positioned within the uphole lateral wellbore tubular portion, the ramped deflector located proximate and ramping toward the exit window. The ramped deflector may include a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion, and for diverting a second downhole tool having a diameter ($D_2$) greater than the diameter ($D_{TB}$) toward the exit window.

19 Claims, 16 Drawing Sheets

(56) References Cited

U.S. PATENT DOCUMENTS

| | | | | |
|---|---|---|---|---|
| 6,158,513 | A | 12/2000 | Nistor et al. | |
| 6,209,644 | B1 * | 4/2001 | Brunet | E21B 41/0042 166/117.6 |
| 6,752,211 | B2 | 6/2004 | Dewey et al. | |
| 7,669,664 | B2 * | 3/2010 | McGarian | E21B 41/0042 166/382 |
| 7,726,401 | B2 | 6/2010 | Parlin et al. | |
| 9,416,638 | B2 * | 8/2016 | Zhou | E21B 34/10 |
| 9,951,573 | B2 * | 4/2018 | Dahl | E21B 41/0035 |
| 10,053,940 | B2 | 8/2018 | Coats | |
| 2002/0162690 | A1 | 11/2002 | Hanton et al. | |
| 2012/0318582 | A1 | 12/2012 | Fould et al. | |
| 2016/0273312 | A1 | 9/2016 | Steele et al. | |
| 2016/0326818 | A1 | 11/2016 | Lajesic | |
| 2017/0362896 | A1 * | 12/2017 | Rodriguez | E21B 41/0035 |
| 2018/0371860 | A1 | 12/2018 | Fripp et al. | |

FOREIGN PATENT DOCUMENTS

| | | | | |
|---|---|---|---|---|
| RU | 2672080 | C1 | 11/2018 | |
| WO | WO-2019194800 | A1 * | 10/2019 | E21B 7/061 |

* cited by examiner

DEFLECTOR ASSEMBLY AND METHOD FOR FORMING A MULTILATERAL WELL

CROSS-REFERENCE TO RELATED APPLICATION

This application claims the benefit of U.S. Provisional Application Ser. No. 62/802,882, filed on Feb. 8, 2019, entitled "PRE-MILLED WHIPSTOCKLESS EXIT AND DEFLECTOR WINDOW AND METHOD", currently incorporated herein by reference in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore.

A multilateral well can include one or more windows or casing exits to allow corresponding lateral wellbores to be formed. The window or casing exits for multilateral wells are typically formed by positioning one or more solid whipstock assemblies in a casing string with a running tool at desired locations in the main wellbore. The solid whipstock assemblies may be used to deflect a window mill relative to the casing string. The deflected window mill penetrates part of the casing joint to form the window or casing exit in the casing string and is then withdrawn from the wellbore. Drill assemblies can be subsequently inserted through the casing exit in order to cut the lateral wellbore, fracture the lateral wellbore, and/or service the lateral wellbore.

Traditional multilateral well construction does not integrate well with the unconventional frac business. For example, traditional multilateral well construction designs and re-entry methods add enough additional cost to the Drill and FRAC program that they often are not an economically viable solution compared to multiple single wells.

SUMMARY

Provided, in one aspect, is a deflector assembly. The deflector assembly, in one embodiment, a tubular member, the tubular member having an uphole lateral wellbore tubular portion and a downhole main wellbore tubular portion, wherein an inside diameter of the uphole lateral wellbore tubular portion ($ID_U$) is greater than an inside diameter of the downhole main wellbore tubular portion ($ID_D$). The deflector assembly according to his embodiment further includes an exit window located in a sidewall of the uphole lateral wellbore tubular portion, and a ramped deflector positioned within the uphole lateral wellbore tubular portion, the ramped deflector located proximate and ramping toward the exit window. In accordance with one aspect, the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion, and for diverting a second downhole tool having a diameter ($D_2$) greater than the diameter ($D_{TB}$) toward the exit window.

BRIEF DESCRIPTION

Reference is now made to the following descriptions taken in conjunction with the accompanying drawings, in which.

DETAILED DESCRIPTION

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open-hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers to a direction that is towards the surface of the well, while the term "downhole" refers to a direction that is away from the surface of the well.

Figure 1:
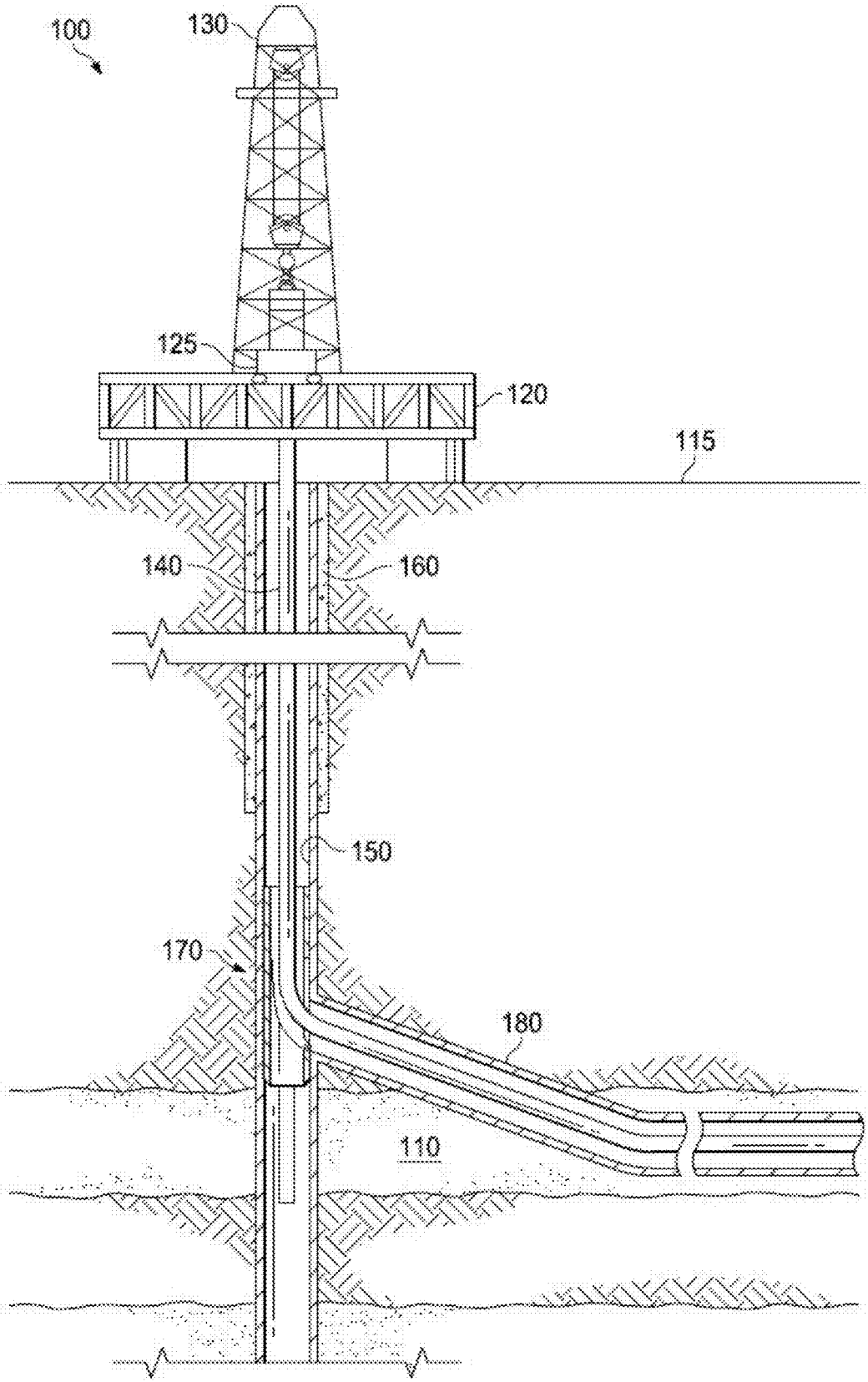
FIG. 1 is a schematic view of a multilateral well 100 according to one or more embodiments disclosed herein.

FIG. 1 is a schematic view of a multilateral well 100 according to one or more embodiments disclosed herein. The multilateral well 100 includes a platform 120 positioned over a subterranean formation 110 located below the earth's surface 115. The platform 120, in at least one embodiment, has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing.

A deflector assembly 170 according to one or more embodiments of the present disclosure may be positioned at a desired intersection between the main wellbore 150 and a lateral wellbore 180. In one or more embodiments, such as the embodiment illustrated in FIG. 1, the deflector assembly 170 is coupled by way of a 7⅝" casing (e.g., via a liner hanger) to the 9⅝" casing string 160. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

Figure 2B:
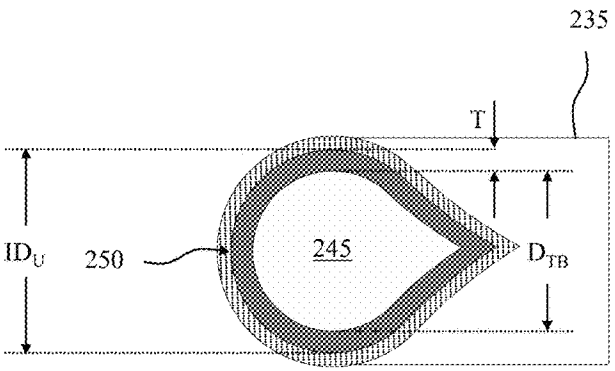
FIGS. 2A and 2B illustrate a deflector assembly designed and manufactured according to one or more embodiments of the disclosure.
Figure 2A:
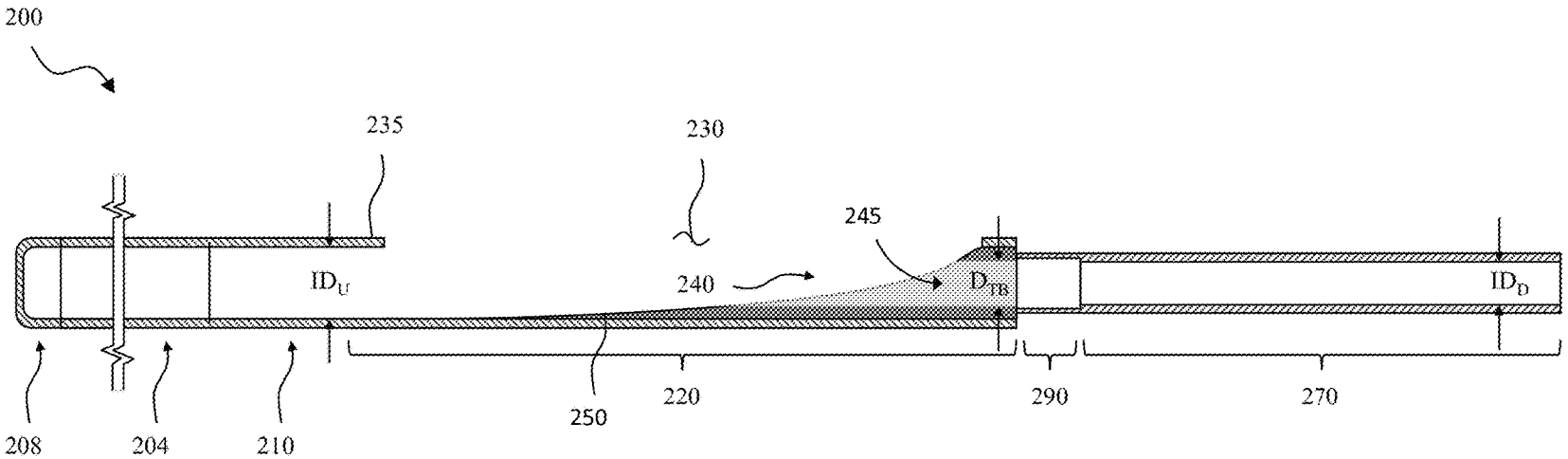

Turning now to FIG. 2A, illustrated is an enlarged cross-sectional view of a deflector assembly 200 designed and manufactured according to one or more embodiments of the disclosure. The deflector assembly 200, in one embodiment, could be used as the deflector assembly 170 illustrated in FIG. 1. The deflector assembly 200, in one or more embodiments, includes a tubular member 210. The tubular member 210 may comprise many different materials and remain within the scope of the disclosure. In the illustrated embodiment of FIG. 2A, however, the tubular member 210 is a steel tubular member.

Coupled to an uphole end of the tubular member 210, in the embodiment shown, is a liner casing 204 and a liner hanger 208. The liner casing 204, in one embodiment, is substantially similar in size (e.g., outer diameter) as the tubular member 210. In fact, in one or more embodiments, the tubular member 210 is an extension of the liner casing 204. The liner casing 204, in one or more embodiments, is a 7⅝" liner casing configured to engage (e.g., via a mule shoe) a larger main bore casing. For example, the larger main bore casing could be a 9⅝" main bore casing, among others, and remain within the scope of the disclosure.

The tubular member 210, in the illustrated embodiment of FIG. 2A, includes an uphole lateral wellbore tubular portion 220 and a downhole main wellbore tubular portion 270. In the illustrated embodiment of FIG. 2A, the tubular portion 210 additionally includes a polished bore receptacle portion 290 located between the uphole lateral wellbore tubular portion 220 and the downhole main wellbore tubular portion 270. The polished bore receptacle portion 290 may provide a suitable surface to seal with a downhole tool being deployed within the deflector assembly 200, including a junction isolation tool or other similar tool. In the illustrated embodiment of FIG. 2A, an inside diameter ($ID_U$) of the uphole lateral wellbore tubular portion 220 is greater than an inside diameter ($ID_D$) of the downhole main wellbore tubular portion 270.

The deflector assembly 200, in one or more embodiments, further includes an exit window 230 located in a sidewall 235 of the uphole lateral wellbore tubular portion 220. The exit window 230 may be a pre-milled exit window and remain within the scope of the disclosure. Those skilled in the art appreciate the steps that would be necessary to form the exit window 230. A width of the exit window 230 should be sufficient to allow one or more different types of downhole tools to exit therefrom, including milling tools, junction isolation tools, etc.

The deflector assembly 200; in one or more embodiments consistent with the disclosure, may additionally include a ramped deflector 240 positioned within the uphole lateral wellbore tubular portion 220. The ramped deflector 240, in accordance with the disclosure, is located proximate and ramping toward the exit window 230. A ramp angle and/or ramp profile of the ramped deflector 240 may vary greatly and remain within the scope of the disclosure, and in fact may be similar to the ramp angles and/or ramp profiles currently used within solid whipstocks. In one or more embodiments of the disclosure, the ramp angle is less than 30 degrees. In one or more different embodiments of the disclosure, the ramp angle is less than 10 degrees, and in yet one or more other different embodiments of the disclosure the ramp angle is less than 6 degrees.

The ramped deflector 240, in one or more embodiments, includes a through bore 245 having a diameter ($D_{TB}$) coupling the uphole lateral wellbore tubular portion 220 and the downhole main wellbore tubular portion 270. In accordance with one or more embodiments, the diameter ($D_{TB}$) of the through bore 245 is substantially equal to the inside diameter ($ID_D$) of the downhole main wellbore tubular portion 270. The phrase "substantially equal" as used herein with regard to the diameters, and unless otherwise stated, requires that the diameters are within ±10 percent of each other. In accordance with one or more other embodiments, the diameter ($D_{TB}$) of the through bore 245 is ideally equal to the inside diameter ($ID_D$) of the downhole main wellbore tubular portion 270. The phrase "ideally equal" as used herein with regard to the diameters, and unless otherwise stated, requires that the diameters are within ±5 percent of each other.

Turning briefly to FIG. 2B, illustrated is perspective view of the ramped deflector 240 looking down through the exit window 230. FIG. 2B clearly illustrates how a first downhole tool having a diameter ($D_1$) less than the diameter ($D_{TB}$) would pass through the through bore 245 in the ramped deflector 240, whereas a second downhole tool having a diameter ($D_2$) greater than the diameter ($D_{TB}$) would deflect along the ramped deflector lip 250 toward the exit window 230. The ramped deflector 240, in one or more embodiments, could be formed by inserting a sleeve having a ramp profile and thickness (T) within the uphole lateral wellbore tubular portion 220 proximate the exit window 230.

Figure 3:
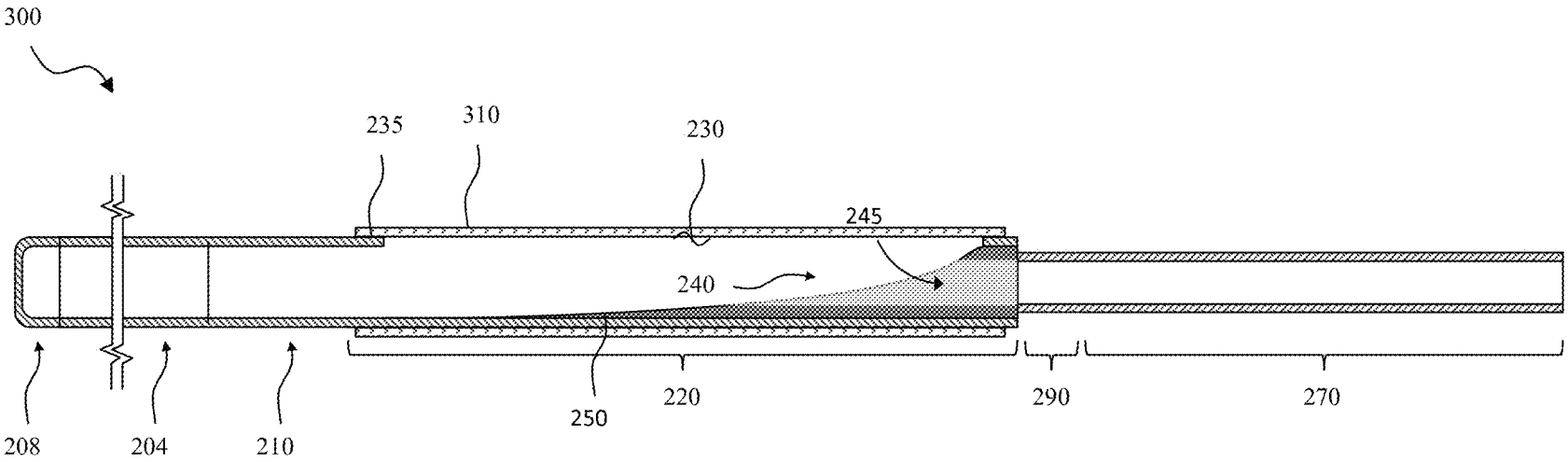
FIG. 3 illustrates an enlarged cross-sectional view of a deflector assembly designed and manufactured according to one or more embodiments of the disclosure.

Turning now to FIG. 3, illustrated is an enlarged cross-sectional view of a deflector assembly 300 designed and manufactured according to one or more embodiments of the disclosure. The deflector assembly 300 is similar in many respects to the deflector assembly 200 discussed with regard to FIG. 2A. Accordingly, like reference numbers have been used to indicate similar, if not identical, features. The deflector assembly 300 differs, for the most part, from the deflector assembly 200 in that the deflector assembly 300 further includes a drillable outer sleeve 310 enclosing the exit window 230. The drillable outer sleeve 310 may comprise many different materials and remain within the scope of the disclosure, so long as the drillable outer sleeve 310 is soft enough to drill, such that a downhole tool may exit the exit window 230, and hard enough to protect an interior of the deflector assembly 300 as the deflector assembly 300 is being run-in-hole. In one embodiment, the drillable outer sleeve 310 comprises aluminum that entirely encloses the exit window 230.

Figure 4:
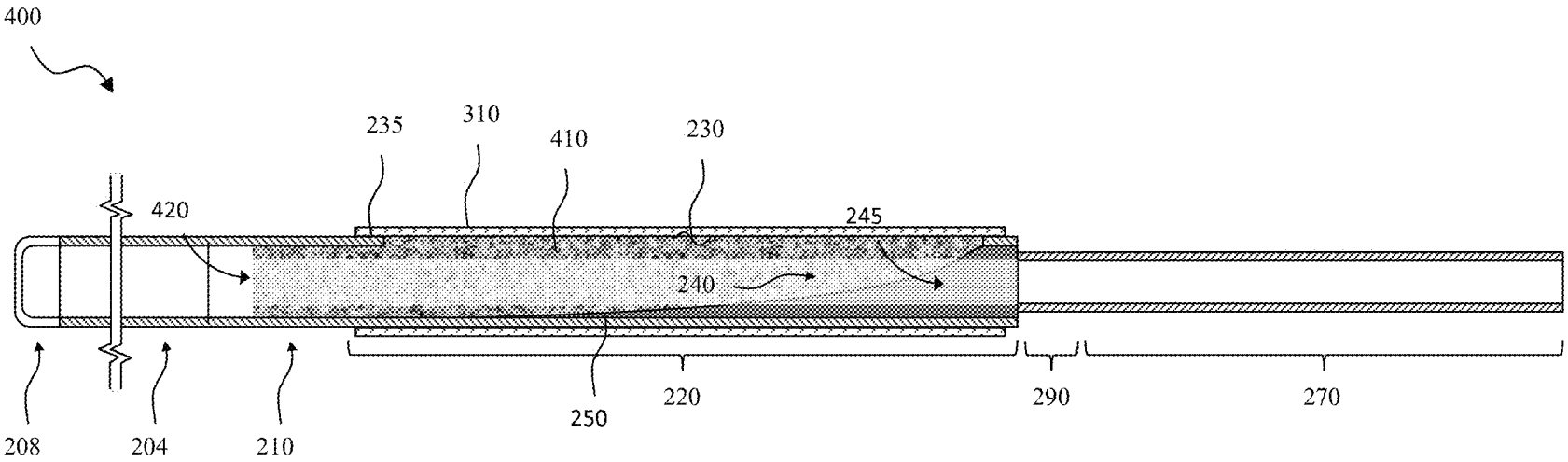
FIG. 4 illustrates an enlarged cross-sectional view of a deflector assembly designed and manufactured according to one or more alternative embodiments of the disclosure.

Turning now to FIG. 4, illustrated is an enlarged cross-sectional view of a deflector assembly 400 designed and manufactured according to one or more embodiments of the disclosure. The deflector assembly 400 is similar in many respects to the deflector assembly 300 discussed with regard to FIG. 3. Accordingly, like reference numbers have been used to indicate similar, if not identical, features. The deflector assembly 400 differs, for the most part, from the deflector assembly 300 in that the deflector assembly 400 further includes filler material 410 substantially filling exposed space between the ramped deflector 240 and the drillable outer sleeve 310. The filler material 410 may comprise different materials and remain within the scope of the disclosure. In one or more embodiments, however, the filler material 410 comprises cement. In accordance with one or more embodiments, a second through bore 420 extends through the filler material 410 to couple the uphole lateral wellbore tubular portion 220 and the downhole main wellbore tubular portion 270.

FIG. 4 illustrates that the filler material 410 is surrounded by the drillable outer sleeve 310. Other embodiments may exist, however, wherein the filler material 410 is not surrounded by the drillable outer sleeve 310, and thus is exposed to an exterior of the tubular member 210 through the exit window 230. In accordance with this embodiment, the filler material 410 would substantially fill exposed space between the ramped deflector 240 and the exit window 230. For example, if the filler material 410 were hard enough to protect an interior of the deflector assembly 400 as the deflector assembly 400 is being run-in-hole, the drillable outer sleeve 310 might not be necessary.

Figure 5B:
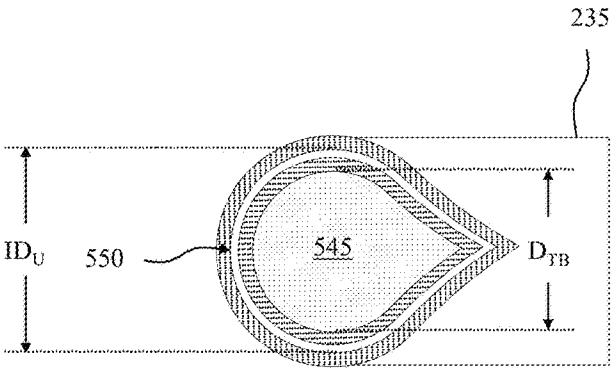
FIGS. 5A and 5B illustrate a deflector assembly designed and manufactured according to one or more alternative embodiments of the disclosure.
Figure 5A:
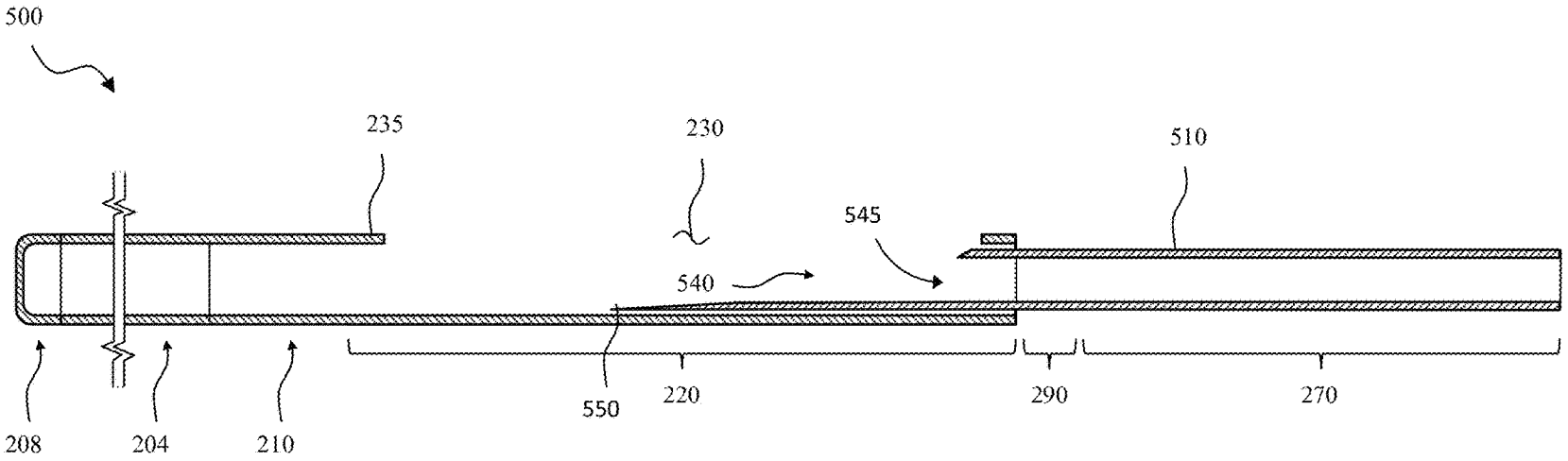

Turning now to FIG. 5A, illustrated is an enlarged cross-sectional view of a deflector assembly 500 designed and manufactured according to one or more embodiments of the disclosure. The deflector assembly 500 is similar in many respects to the deflector assembly 200 discussed with regard to FIG. 2A. Accordingly, like reference numbers have been used to indicate similar, if not identical, features. The deflector assembly 500 differs, for the most part, from the deflector assembly 200 in that the ramped deflector 540 is formed differently than the ramped deflector 240. For example, the deflector assembly 500 of FIG. 5A uses a downhole liner 510 as the downhole main wellbore tubular portion 270. Furthermore, the downhole liner 510 extends into the uphole lateral wellbore tubular portion 220 to form the ramped deflector lip 550 of the ramped deflector 540. According to this embodiment, the downhole liner 510 and the uphole lateral wellbore tubular portion 220 form a single integral piece.

Turning briefly to FIG. 5B, illustrated is perspective view of the ramped deflector 540 looking down through the exit window 230. FIG. 5B clearly illustrates how a first downhole tool having a diameter ($D_1$) less than the diameter ($D_{TB}$) would pass through the through bore 545 in the ramped deflector 540, whereas a second downhole tool having a diameter ($D_2$) greater than the diameter ($D_{TB}$) would deflect along the ramped deflector lip 550 toward the exit window 230.

Figure 6B:
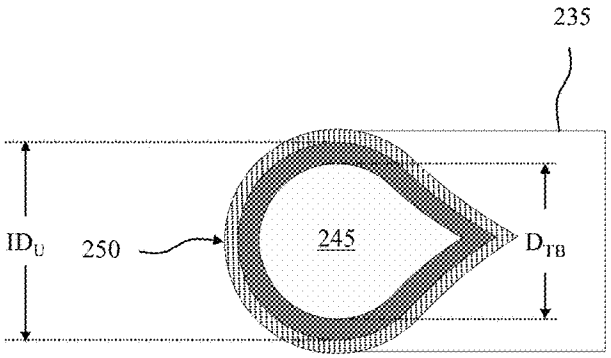
FIGS. 6A through 6C illustrate a deflector assembly designed and manufactured according to one or more alternative embodiments of the disclosure.
Figure 6C:
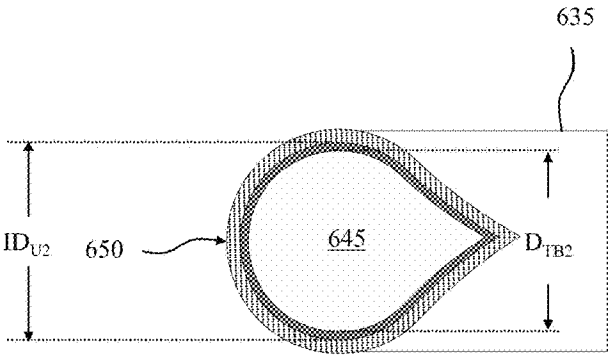
Figure 6A:
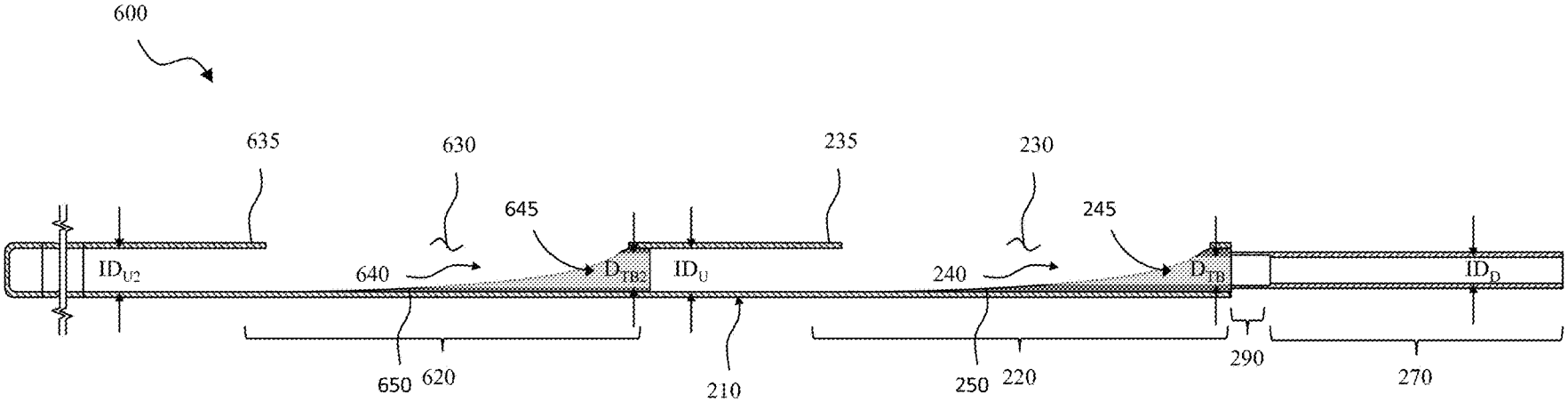

Turning now to FIG. 6A, illustrated is an enlarged cross-sectional view of a deflector assembly 600 designed and manufactured according to one or more embodiments of the disclosure. The deflector assembly 600 is similar in many respects to the deflector assembly 200 discussed with regard to FIG. 2A. Accordingly, like reference numbers have been used to indicate similar, if not identical, features. The deflector assembly 600 differs, for the most part, from the deflector assembly 200 in that the deflector assembly 600 further includes a second uphole lateral wellbore tubular portion 620 located uphole of the first uphole lateral wellbore tubular portion 220. In one or more embodiments, an inside diameter ($ID_{U2}$) of the second uphole lateral wellbore tubular portion 620 is also greater than the inside diameter ($ID_D$) of the downhole main wellbore tubular portion 270. In one or more embodiments, the inside diameter ($ID_{U2}$) of the second uphole lateral wellbore tubular portion 620 is substantially equal to the inside diameter ($ID_{U1}$) of the first uphole lateral wellbore tubular portion 220.

Further to the embodiment of FIG. 6A, the deflector assembly 600 additionally includes a second exit window 630 located in a sidewall 635 of the second uphole lateral wellbore tubular portion 620. The deflector assembly 600 additionally includes a second ramped deflector 640 positioned within the second uphole lateral wellbore tubular portion 620. The second ramped deflector 640, in one or more embodiments, is located proximate and ramping toward the second exit window 630, and furthermore includes a second through bore 645 coupling the second uphole lateral wellbore tubular portion 620 and the first uphole lateral wellbore tubular portion 220. In accordance with one or more embodiments, the second through bore 645 has a diameter ($D_{TB2}$) greater than the first through bore diameter ($D_{TB}$), the second through bore 645 forming a second ramped deflector lip 650. The second ramped deflector lip 650, in one or more embodiments, allows a second downhole tool having the diameter ($D_2$) less than the diameter ($D_{TB2}$) to pass through the second ramped deflector 640 toward the first ramped deflector 240, and diverts a third downhole tool having a diameter ($D_3$) greater than the diameter ($D_{TB2}$) toward the second exit window 630. In accordance with one or more embodiments, the inside diameter ($ID_{U2}$) of the second uphole lateral wellbore tubular portion 620 is substantially equal to the inside diameter ($ID_{U1}$) of the first uphole lateral wellbore tubular portion 220.

Turning briefly to FIGS. 6B and 6C, illustrated are perspective views of the ramped deflector 240 looking down through the exit window 230 and the ramped deflector 640 looking down through the exit window 630, respectively. FIGS. 6B and 6C clearly illustrates how a first downhole tool having a diameter ($D_1$) less than the diameter ($D_{TB2}$) and less than the diameter ($D_{TB}$) would pass through the through bore 645 in the ramped deflector 640 and through the through bore 245 in the ramped deflector 240, respectively. In contrast, a second downhole tool having a diameter ($D_2$) less than the diameter ($D_{TB2}$) but greater than the diameter ($D_{TB}$) would pass through the through bore 645 in the ramped deflector 640 and deflect along the ramped deflector lip 250 out the exit window 230. Furthermore, a third downhole tool having a diameter ($D_3$) greater than the diameter ($D_{TB2}$) would simply deflect out the second ramped deflector lip 650 out the second exit window 630.

Turning to FIGS. 7 through 16, illustrated is one methodology for forming a multilateral well 700 according to one or more embodiments of the disclosure. The multilateral well 700 illustrated in the embodiment of FIG. 7 includes a larger uphole casing section 710 (e.g., 9⅝") and a smaller downhole casing section 720 (e.g., 7⅝"). The multilateral well 700 additionally includes an open hole main wellbore section 730. For example, in the illustrated embodiment of FIG. 7, a drilling assembly 740 is being deployed within the multilateral well 700 to form the main wellbore section 730.

Figure 7:
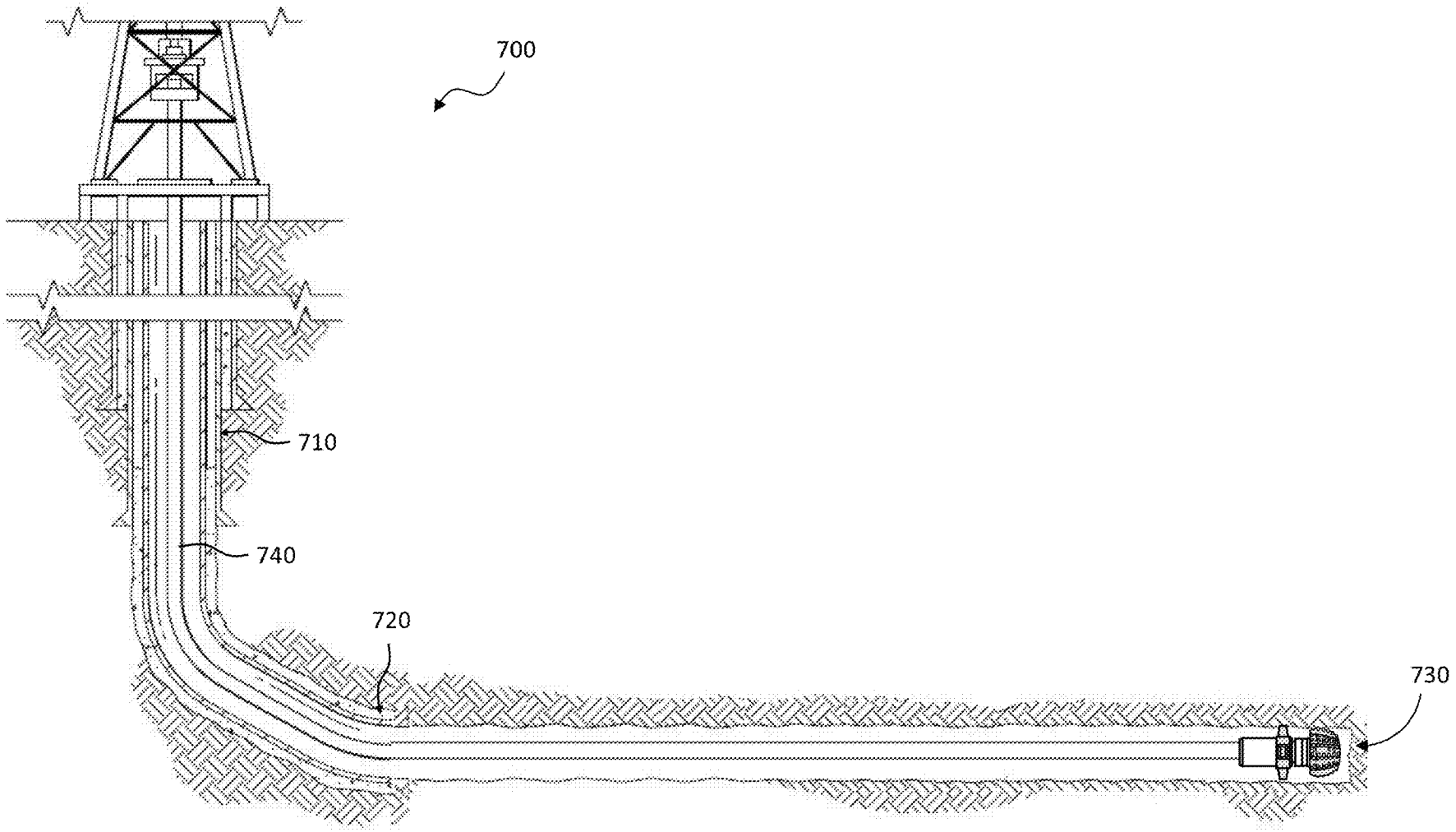
FIGS. 7 through 16 illustrate one methodology for forming a multilateral well according to one or more embodiments of the disclosure.
Figure 8:
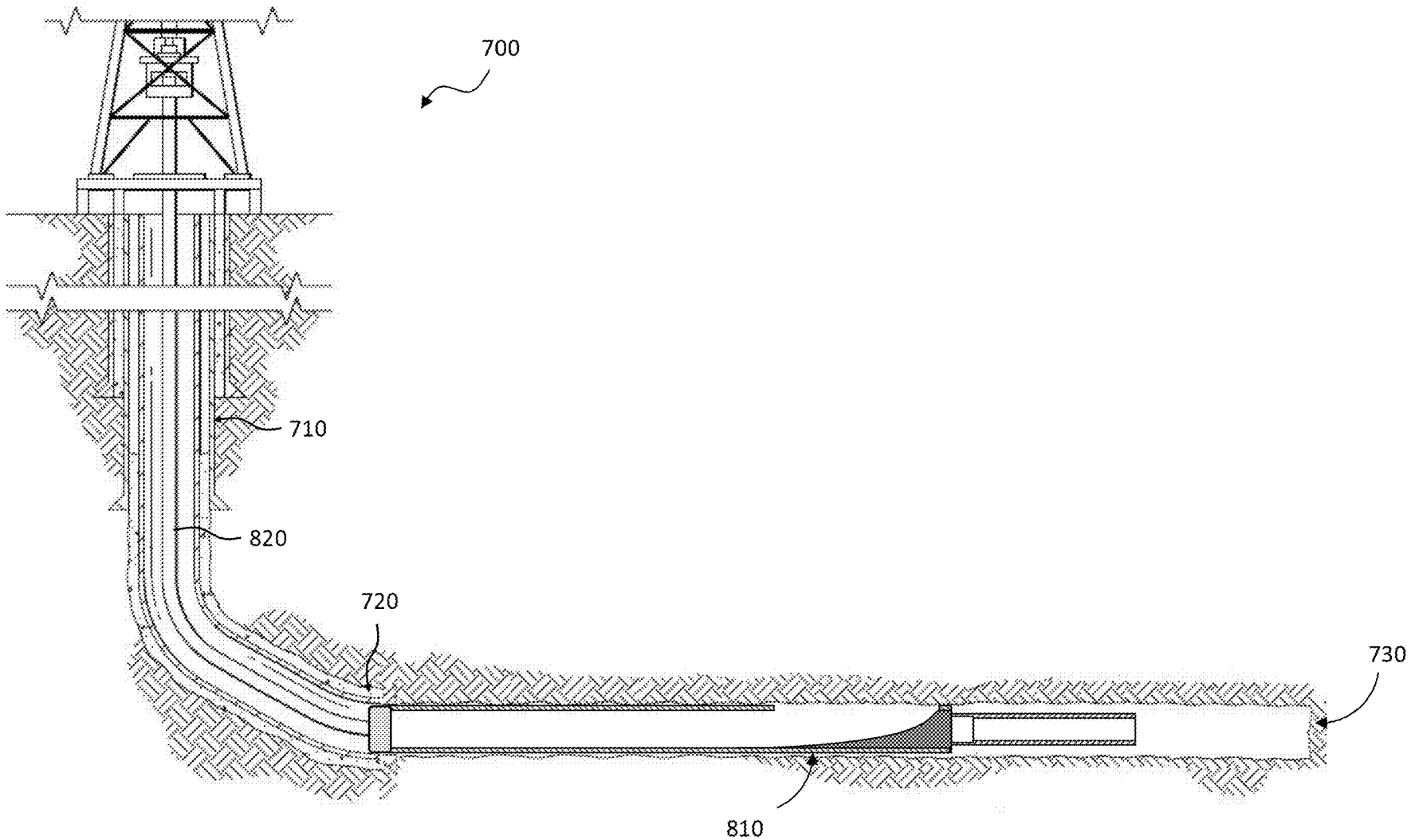

Turning to FIG. 8, illustrated is the multilateral well 700 of FIG. 7 after installing a deflector assembly 810 designed and manufactured according to one or more embodiments of the disclosure at a desired location within the main wellbore section 730. The deflector assembly 810 may be similar to any of the deflector assemblies discussed above, in addition to any other deflector assembly designed and manufactured according to the disclosure. Accordingly, in one or more embodiments, the deflector assembly may include: 1) a tubular member, the tubular member having an uphole lateral wellbore tubular portion and a downhole main wellbore tubular portion, wherein an inside diameter of the uphole lateral wellbore tubular portion ($ID_U$) is greater than an inside diameter of the downhole main wellbore tubular portion ($ID_D$); 2) an exit window located in a sidewall of the uphole lateral wellbore tubular portion thereof; and 3) a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion, and for diverting a second downhole tool having a diameter ($D_2$) greater than the diameter ($D_{TB}$) toward the exit window. In accordance with one embodiment, the deflector assembly 810 is run-in-hole on coiled tubing 820. In accordance with another embodiment, the deflector assembly 810 is run-in-hole on jointed pipe, among other conveyances.

Figure 9:
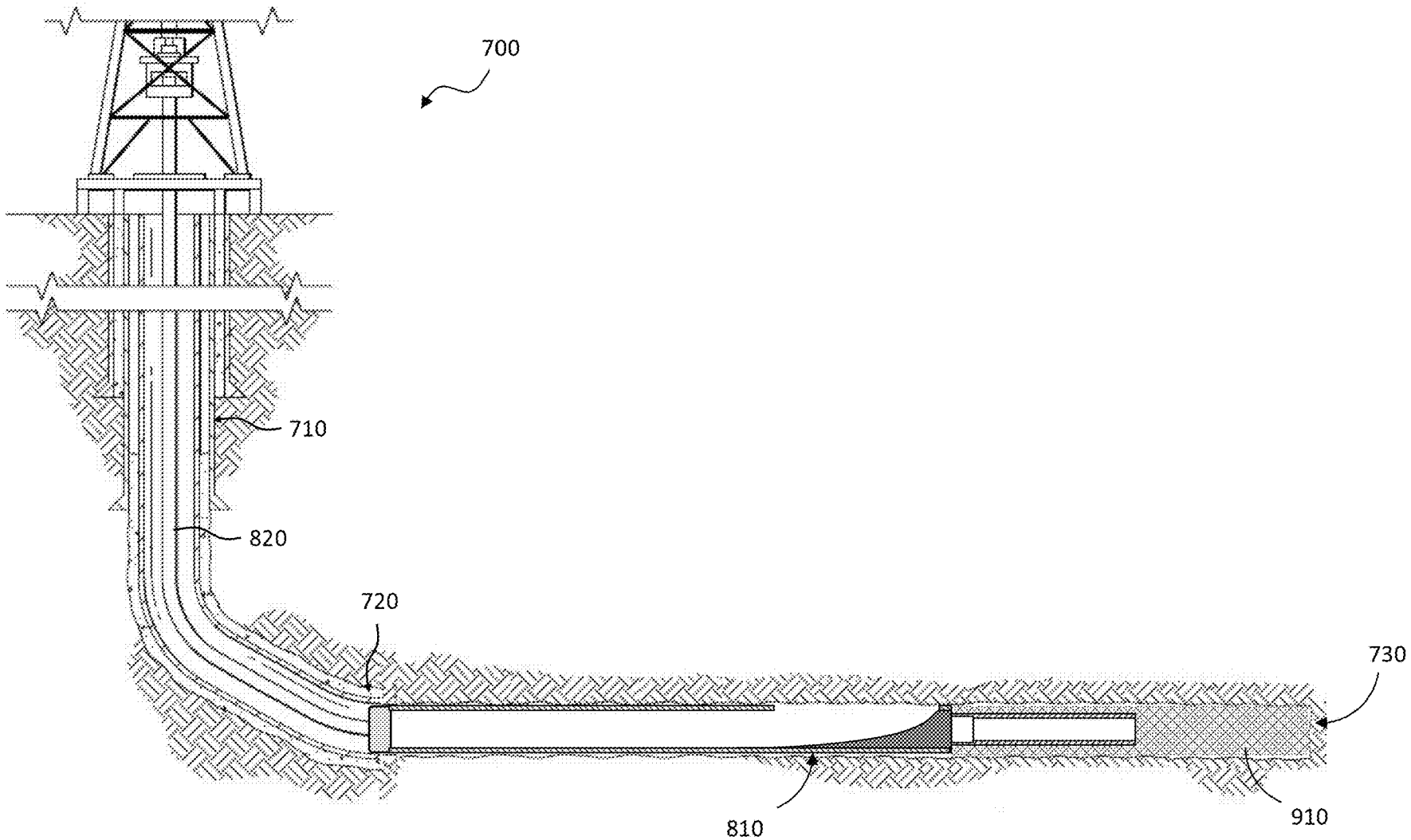

Turning to FIG. 9, illustrated is the multilateral well 700 of FIG. 8 after fixing the deflector assembly 810 in place within the main wellbore section 730 using cement 910. As the deflector assembly 810, and specifically the ramped deflector of the deflector assembly 810, has a through bore there through, the cement 910 may be pumped downhole through the deflector assembly 810 into an annulus between the deflector assembly 810 and the main wellbore section 730. Those skilled in the art appreciate the steps necessary to cement 910 the deflector assembly 810 in place. It should be noted that in one or more embodiments, the deflector assembly 810 is not cemented into place within the main wellbore section 730.

Figure 10:
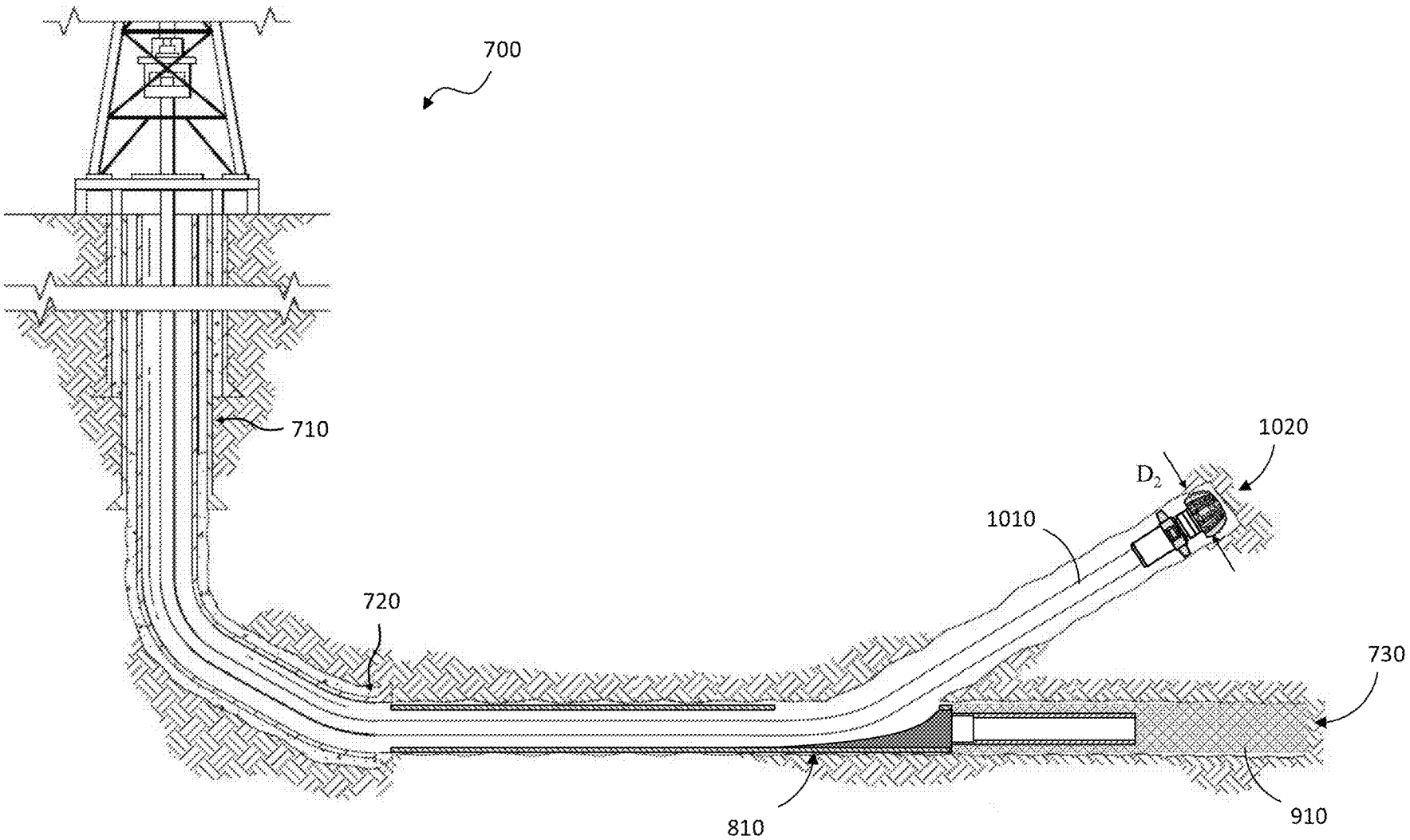

Turning to FIG. 10, illustrated is the multilateral well 700 of FIG. 9 after running a drilling assembly 1010 downhole toward the deflector assembly 810 to form a lateral wellbore section 1020 off of the main wellbore section 730. The drilling assembly 1010, in accordance with one or more embodiments of the disclosure, includes a diameter ($D_2$) greater than the diameter ($D_{TB}$) of the ramped deflector, which in turn causes the drilling assembly 1010 to be deflected out the exit window in the deflector assembly 810, and thus be allowed to form the lateral wellbore section 1020. Were the diameter ($D_2$) of the drilling assembly 1010 to have been less than the diameter ($D_{TB}$) of the ramped deflector, the drilling assembly 1010 would have continued past the deflector assembly 810 toward the main wellbore section 730.

Figure 11:
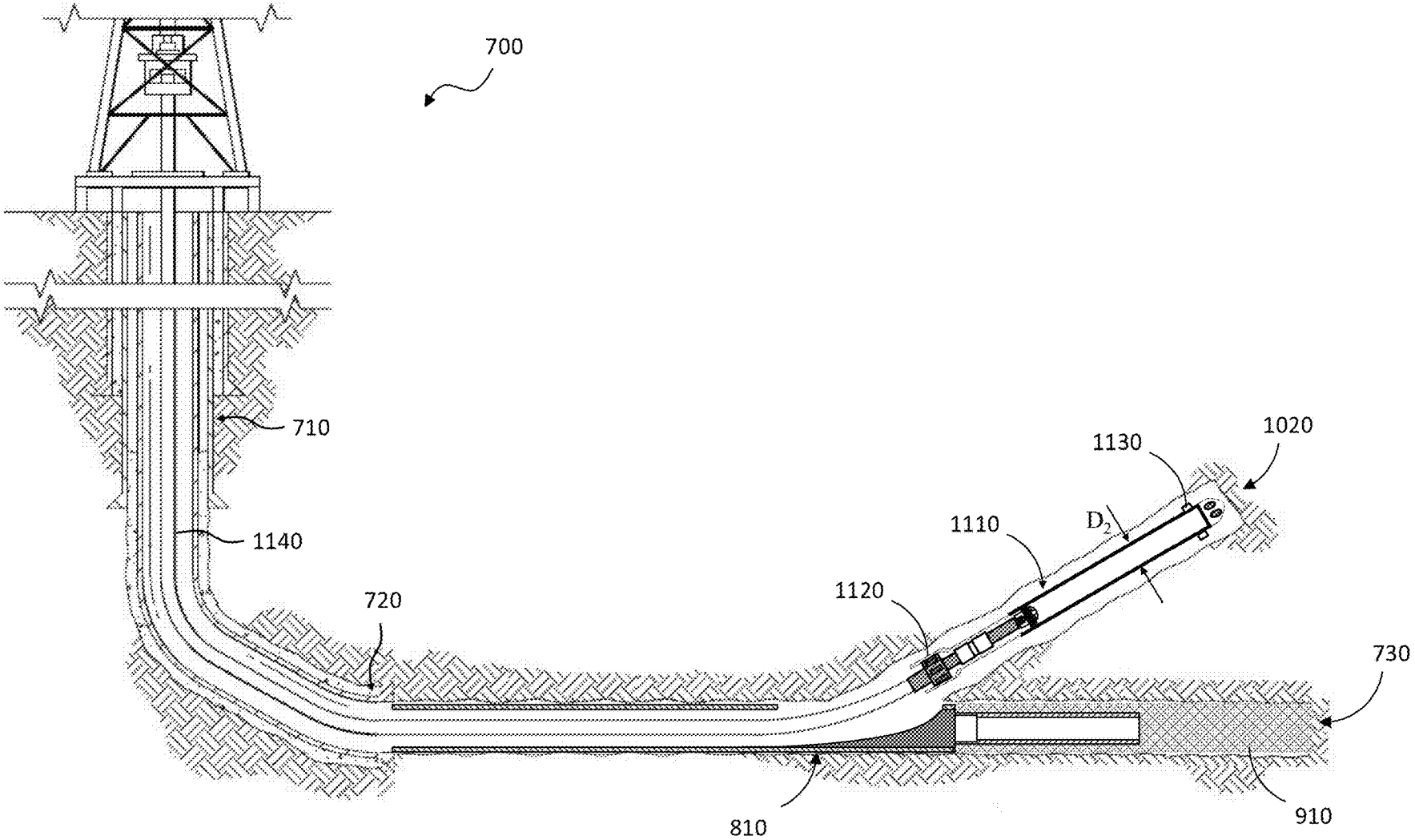

Turning to FIG. 11, illustrated is the multilateral well 700 of FIG. 10 after installing a lateral wellbore liner 1110 within the lateral wellbore section 1020. The lateral wellbore liner 1110, in one or more embodiments, includes a lower lateral receptacle and seal bore 1120 and lower toe sub 1130, among other possible features. The lateral wellbore liner 1110, in accordance with one or more embodiments of the disclosure, includes a diameter ($D_2$) greater than the diameter ($D_{TB}$) of the ramped deflector, which in turn causes the lateral wellbore liner 1110 to be deflected out the exit window in the deflector assembly 810, and thus be allowed to enter the lateral wellbore section 1020. Were the diameter ($D_2$) of the lateral wellbore liner 1110 to have been less than the diameter ($D_{TB}$) of the ramped deflector, the lateral wellbore liner 1110 would have continued past the deflector assembly 810 toward the main wellbore section 730. In accordance with one embodiment, the lateral wellbore liner 1110 is run-in-hole on coiled tubing 1140. In accordance with another embodiment, the lateral wellbore liner 1110 is run-in-hole on jointed pipe, among other conveyances.

Figure 12:
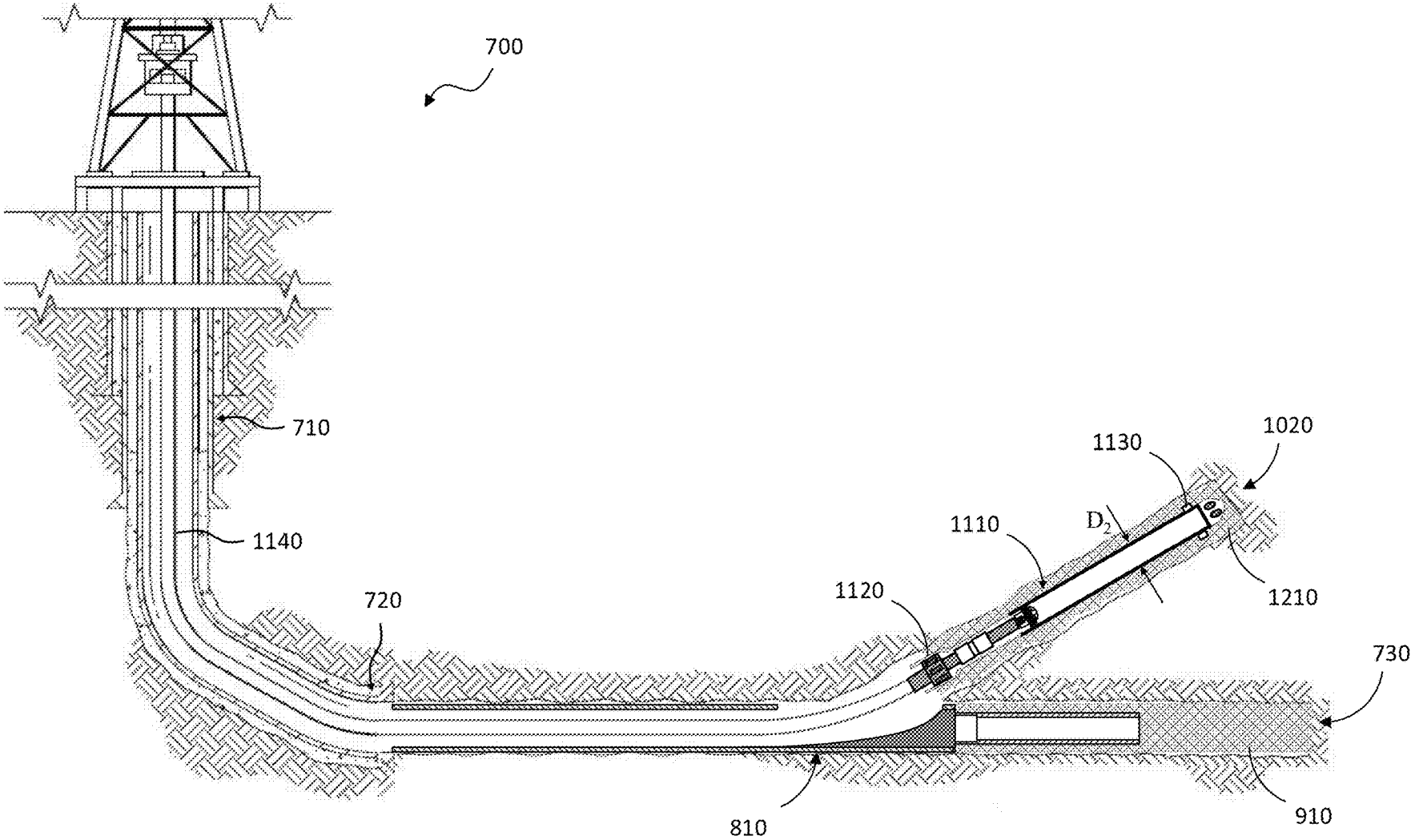

Turning to FIG. 12, illustrated is the multilateral well 700 of FIG. 11 after fixing the lateral wellbore liner 1110 in place within the lateral wellbore section 1020 using cement 1210. Those skilled in the art appreciate the steps necessary to cement 1210 the lateral wellbore liner 1110 in place. It should be noted that in one or more embodiments, the lateral wellbore liner 1110 is not cemented into place within the lateral wellbore section 1020.

Figure 13:
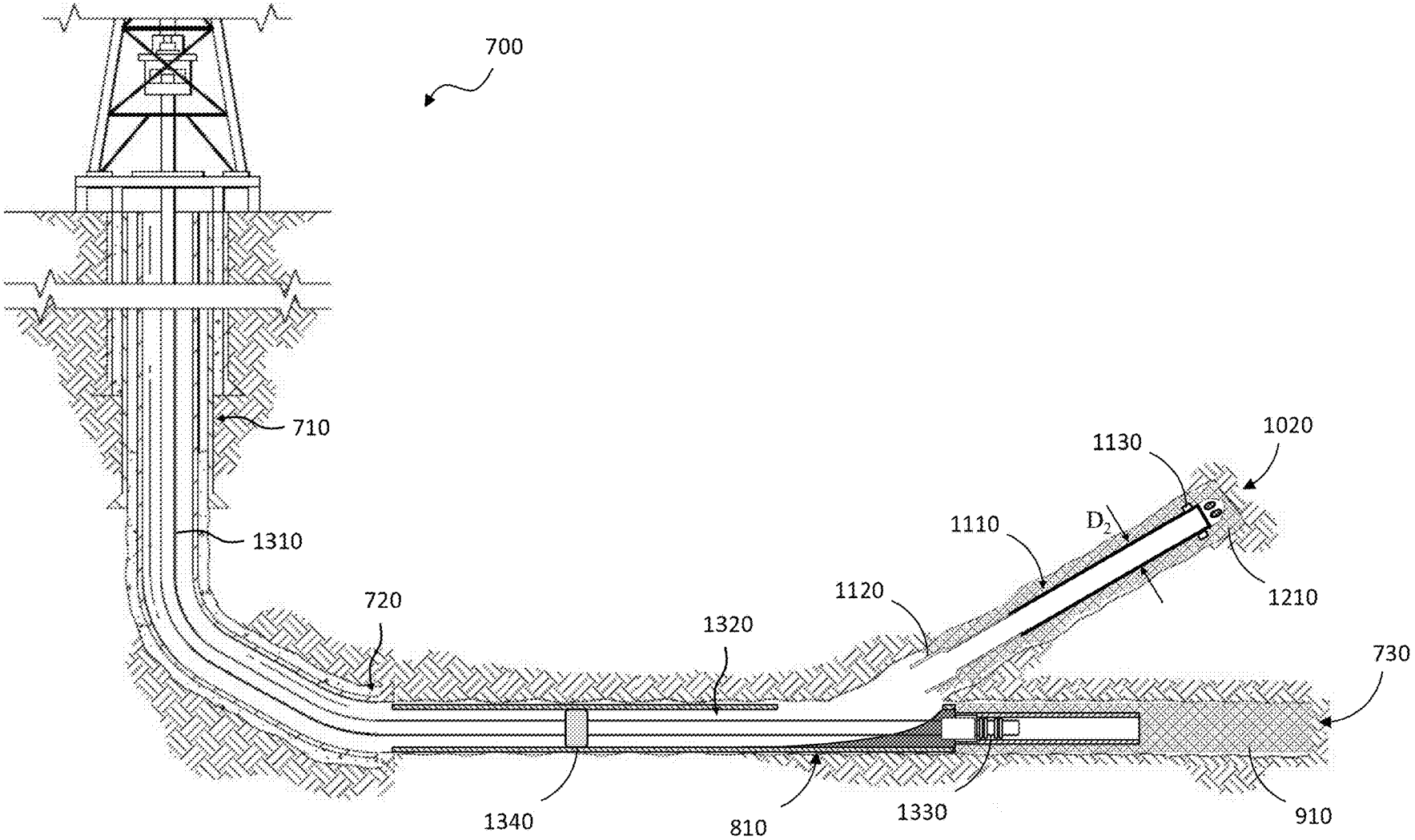

Turning to FIG. 13, illustrated is the multilateral well 700 of FIG. 12 after running a downhole tool 1310 to the main wellbore section 730. In accordance with one or more embodiments, the downhole tool 1310 has a diameter ($D_1$) less than the diameter ($D_{TB}$) of the deflector assembly 810, and thus is allowed to pass through the ramped deflector to the main wellbore tubular portion 730. The downhole tool 1310, in the illustrated embodiment, includes a junction isolation tool 1320 having a shrouded seal assembly 1330 and a cup packer with hold down 1340. In the illustrated embodiment of FIG. 13, the shrouded seal assembly 1330 engages with a polished bore receptacle portion of the deflector assembly 810.

Figure 14:
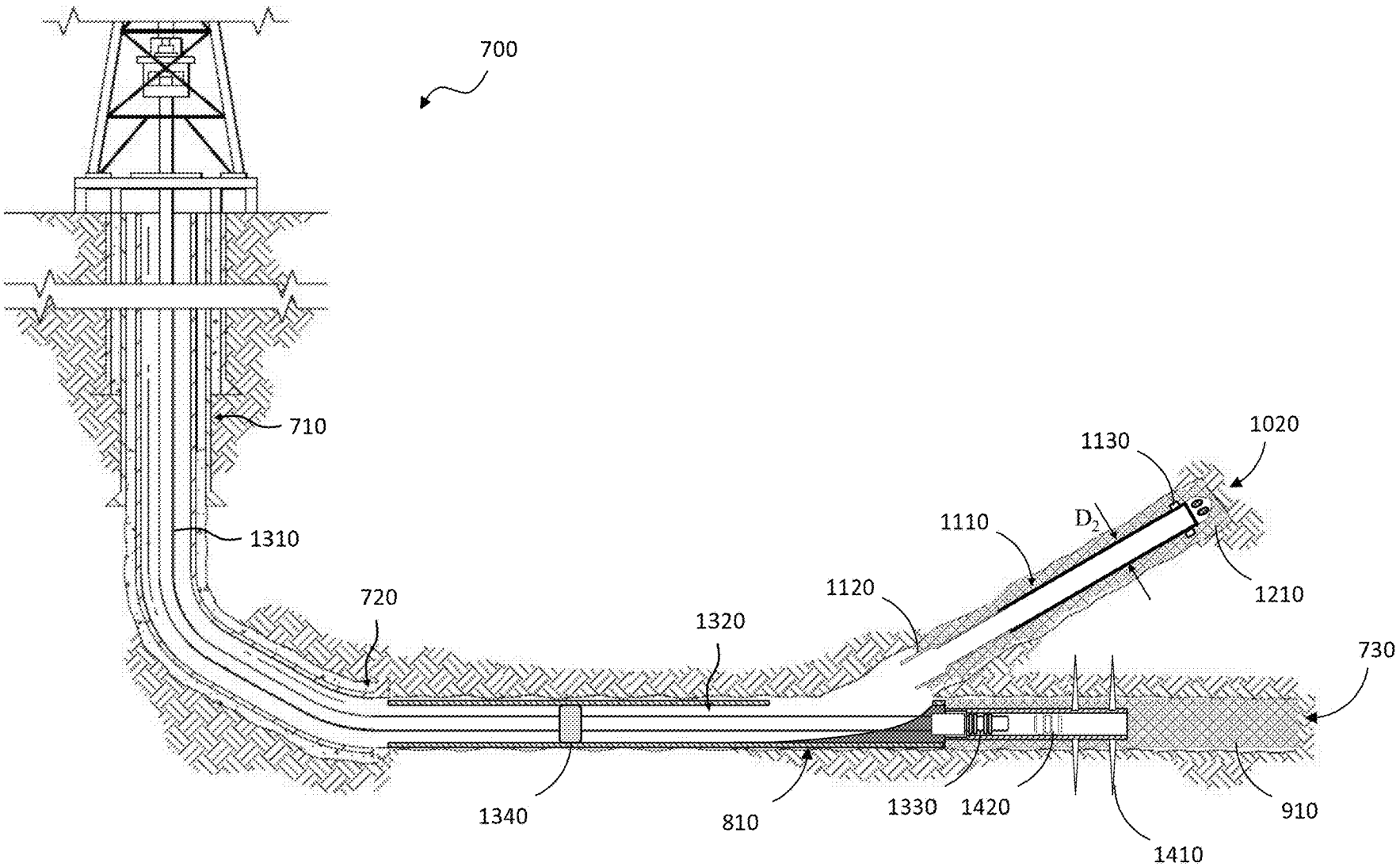

Turning to FIG. 14, illustrated is the multilateral well 700 of FIG. 13 after fracturing the main wellbore section 730, thus forming fractures 1410 in the subterranean formation surrounding the main wellbore section 730. After fracturing the main wellbore section 730, a main wellbore barrier plug 1420 may be placed therein. Those skilled in the art appreciate the processes required to fracture the main wellbore section 730 and place the main wellbore barrier plug 1420 therein.

Figure 15:
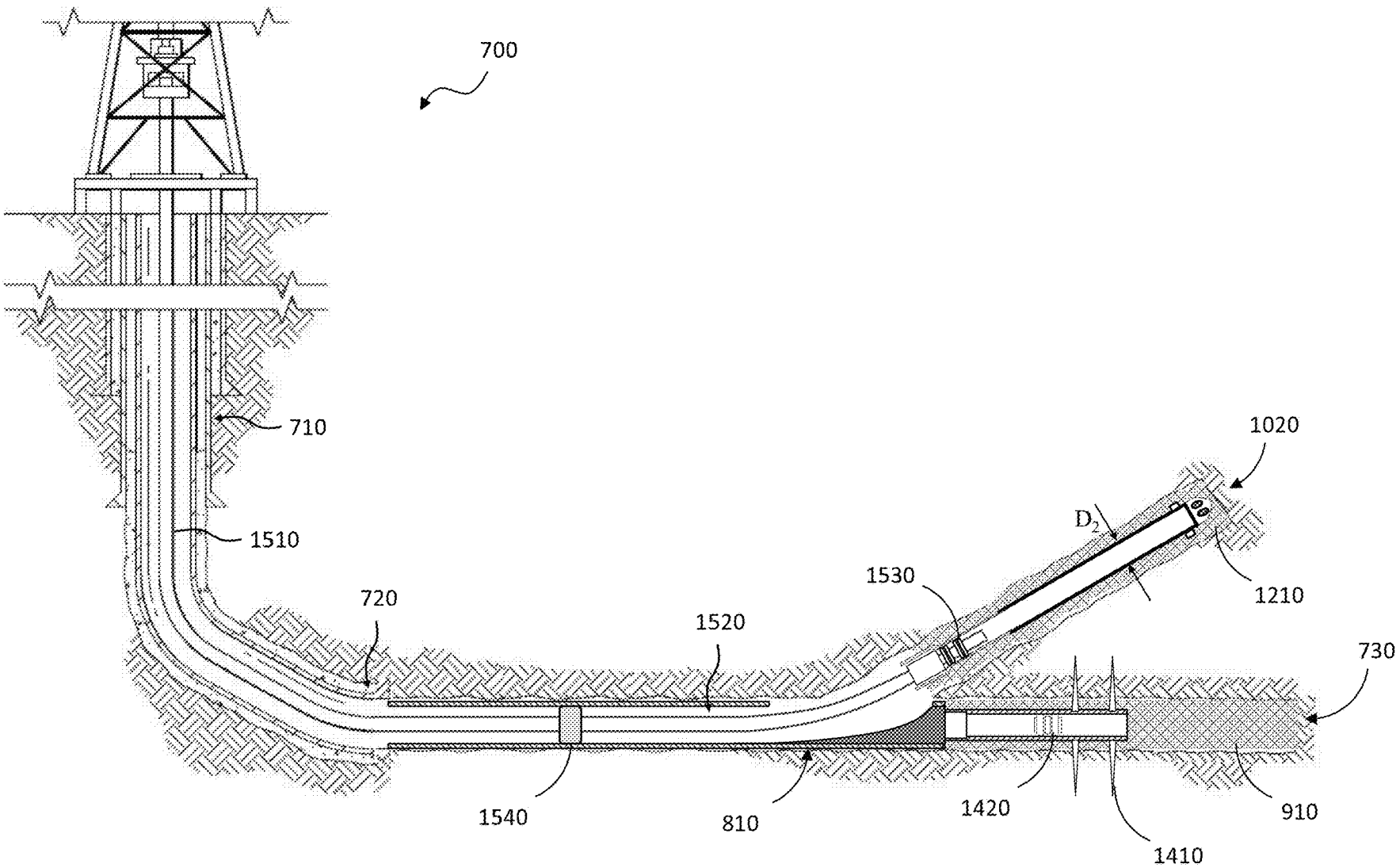

Turning to FIG. 15, illustrated is the multilateral well 700 of FIG. 14 after pulling the downhole tool 1310 out of the multilateral well 700, and inserting a downhole tool 1510 within the multilateral well 700. In accordance with one or more embodiments, the downhole tool 1510 has a diameter ($D_2$) greater than the diameter ($D_{TB}$) of the deflector assembly 810, and thus is deflected out the ramped deflector through the exit window and into the lateral wellbore tubular portion 1020. The downhole tool 1510, in the illustrated embodiment, includes a junction isolation tool 1520 having a shrouded seal assembly 1530 and a cup packer with hold down 1540. In the illustrated embodiment of FIG. 15, the shrouded seal assembly 1530 engages with a lower lateral receptacle and seal bore 1120. In accordance with one embodiment, the downhole tool 1510 is run-in-hole on coiled tubing 1550. In accordance with another embodiment, the downhole tool 1510 is run-in-hole on jointed pipe, among other conveyances.

Figure 16:
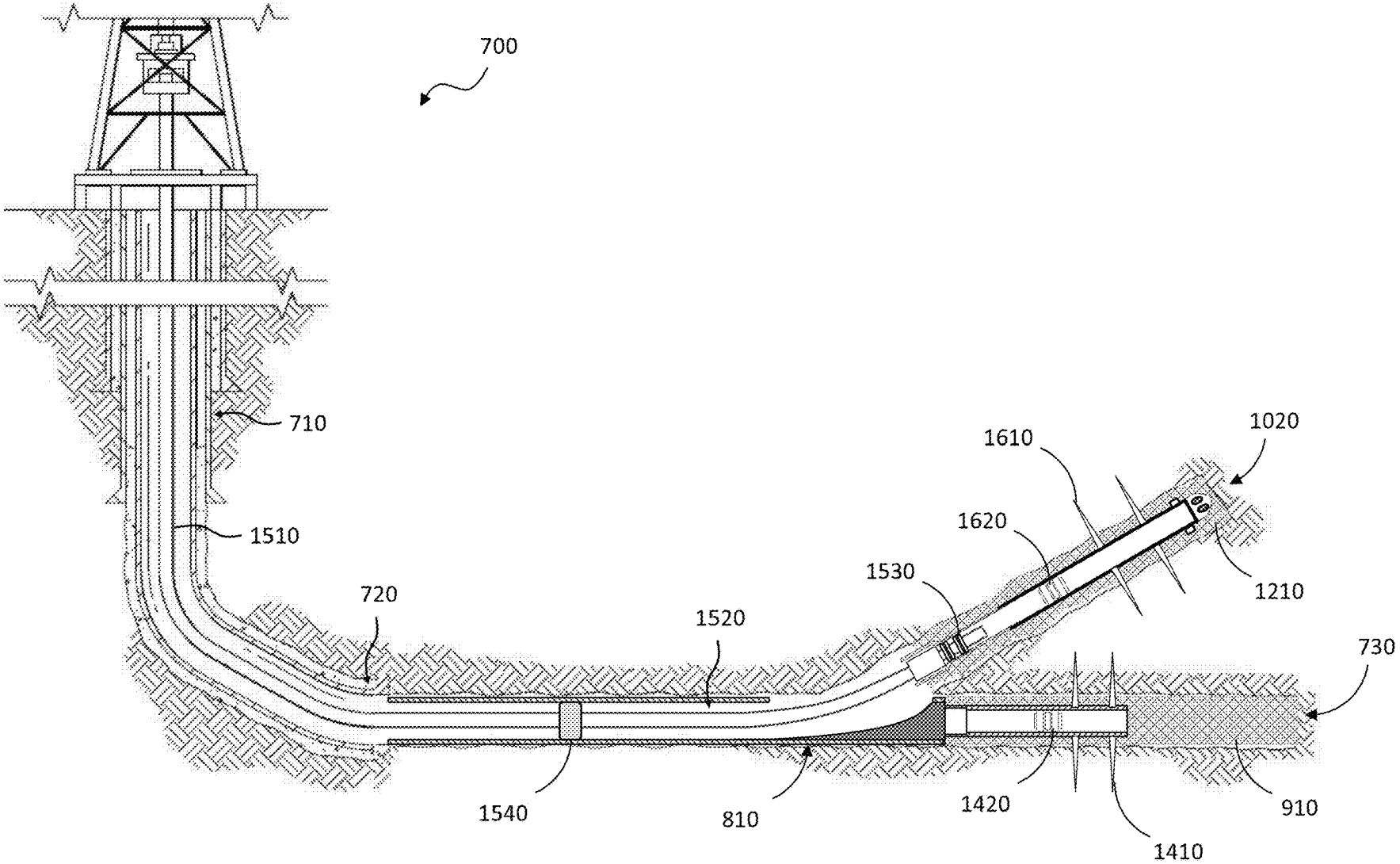

Turning to FIG. 16, illustrated is the multilateral well 700 of FIG. 15 after fracturing the lateral wellbore section 1020, thus forming fractures 1610 in the subterranean formation surrounding the lateral wellbore section 1020. After fracturing the lateral wellbore section 1020, a lateral wellbore barrier plug 1620 may be placed therein. Those skilled in the art appreciate the processes required to fracture the lateral wellbore section 1020 and place the lateral wellbore barrier plug 1620 therein.

Aspects disclosed herein include:

A. A deflector assembly, the deflector assembly including a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, an exit window located in a sidewall of the uphole lateral wellbore tubular portion, and a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion, and for diverting a second downhole tool having a diameter ($D_2$) greater than the diameter ($D_{TB}$) toward the exit window.

B. A method for forming a multilateral well, the method including 1) placing a deflector assembly within a main wellbore located in a subterranean formation, the deflector assembly including a) a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, b) an exit window located in a sidewall of the uphole lateral wellbore tubular portion, and c) a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip; 2) running a first downhole tool having a diameter ($D_1$) less than the diameter ($D_{TB}$) toward the ramped deflector, the ramped deflector lip allowing the first downhole tool to pass through the ramped deflector to the downhole main wellbore tubular portion, and 3) running a second downhole tool having a diameter ($D_2$) greater than the diameter ($D_{TB}$) toward the ramped deflector, the ramped deflector lip diverting the second downhole tool toward the exit window.

C. A multilateral well, the multilateral well including a main wellbore, a lateral wellbore extending from the main wellbore, a deflector assembly located proximate an intersection between the main wellbore and the lateral wellbore, the deflector assembly including a) a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, b) an exit window located in a sidewall of the uphole lateral wellbore tubular portion, and c) a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion, and for diverting a second downhole tool having a diameter ($D_2$) greater than the diameter ($D_{TB}$) toward the exit window.

Aspects A, B, and C may have one or more of the following additional elements in combination: Element 1: further including a drillable outer sleeve enclosing the exit window. Element 2: further including a filler material substantially filling exposed space between the ramped deflector and the drillable outer sleeve, and further wherein a second through bore extends through the filler material to couple the uphole lateral wellbore tubular portion and the downhole main wellbore tubular portion. Element 3: further including a filler material substantially filling exposed space between the ramped deflector and the exit window, and further wherein a second through bore extends through the filler material to couple the uphole lateral wellbore tubular portion and the downhole main wellbore tubular portion. Element 4: wherein the filler material is cement. Element 5: wherein the downhole main wellbore tubular portion is a downhole liner, and further wherein the downhole liner extends into the uphole lateral wellbore tubular portion to form the ramped deflector lip. Element 6: wherein the diameter ($D_{TB}$) of the through bore is substantially equal to the inside diameter ($ID_D$) of the downhole main wellbore tubular portion. Element 7: wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including a second exit window located in a sidewall of the second uphole lateral wellbore tubular portion and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip for allowing the second downhole tool having the diameter ($D_2$) less than the diameter ($D_{TB2}$) to pass through the second ramped deflector toward the first ramped deflector, and for diverting a third downhole tool having a diameter ($D_3$) greater than the diameter ($D_{TB2}$) toward the second exit window. Element 8: wherein the inside diameter ($ID_{U2}$) of the second uphole lateral wellbore tubular portion is substantially equal to the inside diameter ($ID_{U1}$) of the first uphole lateral wellbore tubular portion. Element 9: further including a polished bore receptacle portion located between the uphole lateral wellbore tubular portion and the downhole main wellbore tubular portion. Element 10: wherein the second downhole tool is a drilling assembly having the diameter ($D_2$) greater than the diameter ($D_{TB}$), and further including drilling a lateral wellbore into the subterranean formation by diverting the drilling assembly toward the exit window using the ramped deflector lip. Element 11: wherein the first downhole tool is a junction isolation tool having the diameter ($D_1$) less than the diameter ($D_{TB}$), and further including fracturing the main wellbore by running the junction isolation tool through the ramped deflector and into the main wellbore tubular portion and subjecting the downhole main wellbore tubular portion to increased pressure to fracture the main wellbore. Element 12: further including a polished bore receptacle portion located between the uphole lateral wellbore tubular portion and the downhole main wellbore tubular portion, and wherein fracturing the main wellbore by running the junction isolation tool through the ramped deflector and into the main wellbore tubular portion includes seating the junction isolation tool within the polish bore receptacle portion and then subjecting the downhole main wellbore tubular portion to the increased pressure to fracture the main wellbore. Element 13: wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including a second exit window located in a sidewall of the second uphole lateral wellbore tubular portion, and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip. Element 14: further including running a third downhole tool having a diameter ($D_3$) greater than the diameter ($D_{TB2}$) toward the second ramped deflector, the second ramped deflector lip diverting the third downhole tool toward the second exit window. Element 15: wherein the inside diameter ($ID_{U2}$) of the second uphole lateral wellbore tubular portion is substantially equal to the inside diameter ($ID_{U1}$) of the first uphole lateral wellbore tubular portion. Element 16: wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including a second exit window located in a sidewall of the second uphole lateral wellbore tubular portion, and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip for allowing the second downhole tool having the diameter ($D_2$) less than the diameter ($D_{TB2}$) to pass through the second ramped deflector toward the first ramped deflector, and for diverting a third downhole tool having a diameter ($D_3$) greater than the diameter ($D_{TB2}$) toward the second exit window. Element 17: wherein the inside diameter ($ID_{U2}$) of the second uphole lateral wellbore tubular portion is substantially equal to the inside diameter ($ID_{U1}$) of the first uphole lateral wellbore tubular portion.

Those skilled in the art to which this application relates will appreciate that other and further additions, deletions, substitutions and modifications may be made to the described embodiments.

What is claimed is:

1. A deflector assembly, comprising:

a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, and a polished bore receptacle portion located between the uphole lateral wellbore tubular portion and the downhole main wellbore tubular portion, the polished bore receptacle configured to seal with a downhole tool extending through the inside diameter ($ID_U$) of the uphole lateral wellbore tubular portion and toward the downhole main wellbore tubular portion;

an exit window located in a sidewall of the uphole lateral wellbore tubular portion; and a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion and engage the polished bore receptacle portion, and for diverting a second downhole tool having a diameter ($D_2$) greater than the diameter ($D_{TB}$) toward the exit window.

2. The deflector assembly as recited in claim 1, further including a drillable outer sleeve enclosing the exit window.

3. The deflector assembly as recited in claim 2, further including a filler material substantially filling exposed space between the ramped deflector and the drillable outer sleeve, and further wherein a second through bore extends through the filler material to couple the uphole lateral wellbore tubular portion and the downhole main wellbore tubular portion.

4. The deflector assembly as recited in claim 1, further including a filler material substantially filling exposed space between the ramped deflector and the exit window, and further wherein a second through bore extends through the filler material to couple the uphole lateral wellbore tubular portion and the downhole main wellbore tubular portion.

5. The deflector assembly as recited in claim 4, wherein the filler material is cement.

6. The deflector assembly as recited in claim 1, wherein the downhole main wellbore tubular portion is a downhole liner, and further wherein the downhole liner extends into the uphole lateral wellbore tubular portion to form the ramped deflector lip.

7. The deflector assembly as recited in claim 1, wherein the diameter ($D_{TB}$) of the through bore is substantially equal to the inside diameter ($ID_D$) of the downhole main wellbore tubular portion.

8. The deflector assembly as recited in claim 1, wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including;

a second exit window located in a sidewall of the second uphole lateral wellbore tubular portion; and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip for allowing the second downhole tool having the diameter ($D_2$) less than the diameter ($D_{TB2}$) to pass through the second ramped deflector toward the first ramped deflector, and for diverting a third downhole tool having a diameter ($D_3$) greater than the diameter ($D_{TB2}$) toward the second exit window.

9. The deflector assembly as recited in claim 8, wherein the inside diameter ($ID_{U2}$) of the second uphole lateral wellbore tubular portion is substantially equal to the inside diameter ($ID_U$) of the first uphole lateral wellbore tubular portion.

10. A method for forming a multilateral well, comprising:

placing a deflector assembly within a main wellbore located in a subterranean formation, the deflector assembly including;

a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, and a polished bore receptacle portion located between the uphole lateral wellbore tubular portion and the downhole main wellbore tubular portion, the polished bore receptacle configured to seal with a downhole tool extending through the inside diameter ($ID_U$) of the uphole lateral wellbore tubular portion and toward the downhole main wellbore tubular portion;

an exit window located in a sidewall of the uphole lateral wellbore tubular portion; and a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip;

running a first downhole tool having a diameter ($D_1$) less than the diameter ($D_{TB}$) toward the ramped deflector, the ramped deflector lip allowing the first downhole tool to pass through the ramped deflector to the downhole main wellbore tubular portion and engage the polished bore receptacle portion; and running a second downhole tool having a diameter ($D_2$) greater than the diameter ($D_{TB}$) toward the ramped deflector, the ramped deflector lip diverting the second downhole tool toward the exit window.

11. The method as recited in claim 10, wherein the second downhole tool is a drilling assembly having the diameter ($D_2$) greater than the diameter ($D_{TB}$), and further including drilling a lateral wellbore into the subterranean formation by diverting the drilling assembly toward the exit window using the ramped deflector lip.

12. The method as recited in claim 11, wherein the first downhole tool is a junction isolation tool having the diameter ($D_1$) less than the diameter ($D_{TB}$), and further including fracturing the main wellbore by running the junction isolation tool through the ramped deflector and into the downhole main wellbore tubular portion and subjecting the downhole main wellbore tubular portion to increased pressure to fracture the main wellbore.

13. The method as recited in claim 12, wherein fracturing the main wellbore by running the junction isolation tool through the ramped deflector and into the downhole main wellbore tubular portion includes seating the junction isolation tool within the polished bore receptacle portion and then subjecting the downhole main wellbore tubular portion to the increased pressure to fracture the main wellbore.

14. The method as recited in claim 10, wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including;

a second exit window located in a sidewall of the second uphole lateral wellbore tubular portion; and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip.

15. The method as recited in claim 14, further including running a third downhole tool having a diameter ($D_3$) greater than the diameter ($D_{TB2}$) toward the second ramped deflector, the second ramped deflector lip diverting the third downhole tool toward the second exit window.

16. The method as recited in claim 15, wherein the inside diameter ($ID_{U2}$) of the second uphole lateral wellbore tubular portion is substantially equal to the inside diameter ($ID_U$) of the first uphole lateral wellbore tubular portion.

17. A multilateral well, comprising:

a main wellbore;

a lateral wellbore extending from the main wellbore; and a deflector assembly located proximate an intersection between the main wellbore and the lateral wellbore, the deflector assembly including;

a tubular member, the tubular member having an uphole lateral wellbore tubular portion and a downhole main wellbore tubular portion, wherein an inside diameter ($ID_U$) of the uphole lateral wellbore tubular portion is greater than an inside diameter ($ID_D$) of the downhole main wellbore tubular portion, and a polished bore receptacle portion located between the uphole lateral wellbore tubular portion and the downhole main wellbore tubular portion, the polished bore receptacle configured to seal with a downhole tool extending through the inside diameter ($ID_U$) of the uphole lateral wellbore tubular portion and toward the downhole main wellbore tubular portion;

an exit window located in a sidewall of the uphole lateral wellbore tubular portion; and a ramped deflector positioned within the uphole lateral wellbore tubular portion, the ramped deflector located proximate and ramping toward the exit window, and further wherein the ramped deflector includes a through bore having a diameter ($D_{TB}$) coupling the uphole lateral wellbore tubular portion and the downhole main wellbore tubular portion, the through bore forming a ramped deflector lip for allowing a first downhole tool having a diameter ($D_1$) less than the diameter ($D_{TB}$) to pass through the ramped deflector to the downhole main wellbore tubular portion and engage the polished bore receptacle portion, and for diverting a second downhole tool having a diameter ($D_2$) greater than the diameter ($D_{TB}$) toward the exit window.

18. The multilateral well as recited in claim 17, wherein the uphole lateral wellbore tubular portion is a first uphole lateral wellbore tubular portion, and the ramped deflector is a first ramped deflector, and wherein the tubular member further includes a second uphole lateral wellbore tubular portion located uphole of the first uphole lateral wellbore tubular portion, wherein an inside diameter ($ID_{U2}$) of the second uphole lateral wellbore tubular portion is greater than the inside diameter ($ID_D$) of the downhole main wellbore tubular portion, and further including;

a second exit window located in a sidewall of the second uphole lateral wellbore tubular portion; and a second ramped deflector positioned within the second uphole lateral wellbore tubular portion, the second ramped deflector located proximate and ramping toward the second exit window, and further wherein the second ramped deflector includes a second through bore coupling the second uphole lateral wellbore tubular portion and the first uphole lateral wellbore tubular portion, the second through bore having a diameter ($D_{TB2}$) greater than the first through bore diameter ($D_{TB}$), the second through bore forming a second ramped deflector lip for allowing the second downhole tool having the diameter ($D_2$) less than the diameter ($D_{TB2}$) to pass through the second ramped deflector toward the first ramped deflector, and for diverting a third downhole tool having a diameter ($D_3$) greater than the diameter ($D_{TB2}$) toward the second exit window.

19. The multilateral well as recited in claim 18, wherein the inside diameter ($ID_{U2}$) of the second uphole lateral wellbore tubular portion is substantially equal to the inside diameter ($ID_U$) of the first uphole lateral wellbore tubular portion.

* * * * *